US006699071B1

(12) United States Patent
Hyland

(10) Patent No.: US 6,699,071 B1
(45) Date of Patent: Mar. 2, 2004

(54) ELECTRICAL CONNECTOR WITH RETENTION MECHANISM OF OUTER SHELL

(75) Inventor: James H. Hyland, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/279,166

(22) Filed: Oct. 23, 2002

(51) Int. Cl.[7] ..... H01R 13/648
(52) U.S. Cl. ..... 439/607; 439/939
(58) Field of Search ..... 439/607–610, 439/939, 676

(56) References Cited

U.S. PATENT DOCUMENTS

| | | | | |
|---|---|---|---|---|
| 4,878,858 A | | 11/1989 | Dechelette | |
| 5,083,945 A | | 1/1992 | Miskin et al. | |
| 5,378,172 A | | 1/1995 | Roberts | |
| 5,766,041 A | | 6/1998 | Morin et al. | |
| 5,775,946 A | | 7/1998 | Briones | |
| 5,788,538 A | | 8/1998 | Belopolsky et al. | |
| 5,957,726 A | * | 9/1999 | Belopolsky et al. | 439/939 |
| 6,066,001 A | * | 5/2000 | Liptak et al. | 439/939 |
| 6,383,024 B1 | * | 5/2002 | Wang et al. | 439/607 |
| 6,402,554 B1 | * | 6/2002 | Yeh | 439/607 |
| 6,419,529 B1 | * | 7/2002 | Shi et al. | 439/607 |
| 6,454,603 B2 | * | 9/2002 | Casey et al. | 439/607 |

* cited by examiner

*Primary Examiner*—Gary Paumen
(74) *Attorney, Agent, or Firm*—Wei Te Chung

(57) ABSTRACT

An electrical connector (100) is mounted on a Printed Circuit Board (PCB) and extends into a cavity (2001) of an electronic appliance (200). The cavity (200) of the electronic appliance includes a metallic internal circumference (2002). The electrical connector includes an insulative housing (1), a plurality of terminals (3) received in the housing, and a shell (2) substantially surrounding the insulative housing. The housing includes front, rear, upper, lower, and side surfaces (10, 12, 11, 14, 13). A plurality of protrusions project from the lower surface of the housing. The shell has a plurality of tabs (241) stamped from the shell and thereby defining corresponding holes (242) engaging with the protrusions of the housing.

3 Claims, 4 Drawing Sheets

ELECTRICAL CONNECTOR WITH RETENTION MECHANISM OF OUTER SHELL

CROSS REFERENCE OF THE RELATED APPLICATIONS

This application is related to U.S. Patent application entitled "ELECTRICAL CONNECTOR WITH REAR GROUND PLATE", which is contemporaneously filed, and assigned to the common assignee.

BACKGROUND OF THE INVENTION

1. Field of the Invention

The present invention relates to electrical connectors and more particularly, to a multi-port modular jack having retention means for securing a shell to an insulative housing.

2. Description of the Related Art

High-speed modular jacks usually have metallic shells for avoiding electromagnetic interference (EMI). U.S. Pat. No. 5,378,172 issued to Roberts on Jan. 3, 1995 disclosed a conventional shielded jack. The Roberts jack is provided for mounting to a Printed Circuit Board (PCB) and includes a dielectric housing and a one-piece shield substantially surrounding the housing. The shield also has a pair of solder tails extending downwardly for inserting into appropriate holes in the PCB and for soldering to appropriate ground traces on the PCB. The housing defines recesses in a bottom board mounting wall at a juncture of the bottom wall with a front or side walls of the housing. The shield forms supporting tabs at bottom edges of the shield extending into the recesses for retaining of the shield to the housing.

However, to a connector of multi-port, the elongated front wall of the shield needs to provide more retaining force to abut tightly against a front face of the housing.

U.S. Pat. No. 5,775,946 issued to Briones on Jul. 7, 1998 disclosed a conventional multi-port RJ-type electrical connector. The connector mounted on a PCB includes a plurality of openings in side by side relationship for receiving mating plugs. The Briones connector includes a housing and a one-piece stamped shield. The housing defines a plurality of cavities in a lower side thereof. The shield includes a plurality of latches engaging with corresponding cavities of the housing.

However, the Briones latches are relatively weak, and thus the engagement between the latch with the cavity may be destroyed by repeated insertion and withdraw of the plugs.

Hence, an electrical connector with an improved shell retaining arrangement is needed to overcome the foregoing shortcomings.

BRIEF SUMMARY OF THE INVENTION

A main object of the present invention is to provide an electrical connector with retention means for securing a shell to an insulative housing.

An electrical connector is mounted on a printed circuit board (PCB) and extends into a cavity of an electronic appliance. The cavity of the electronic appliance includes a metallic internal circumference. The electrical connector includes an insulative housing, a plurality of terminals received in the housing, and a shell substantially surrounding the insulative housing. The housing includes front, rear, upper, lower, and side surfaces. A plurality of protrusions project from the lower surface of the housing. The shell has a plurality of tabs stamped from the shell and thereby defining corresponding holes engaging with the protrusions of the housing.

Other objects, advantages and novel features of the invention will become more apparent from the following detailed description when taken in conjunction with the accompanying drawings.

DETAILED DESCRIPTION OF THE INVENTION

Figure 1:
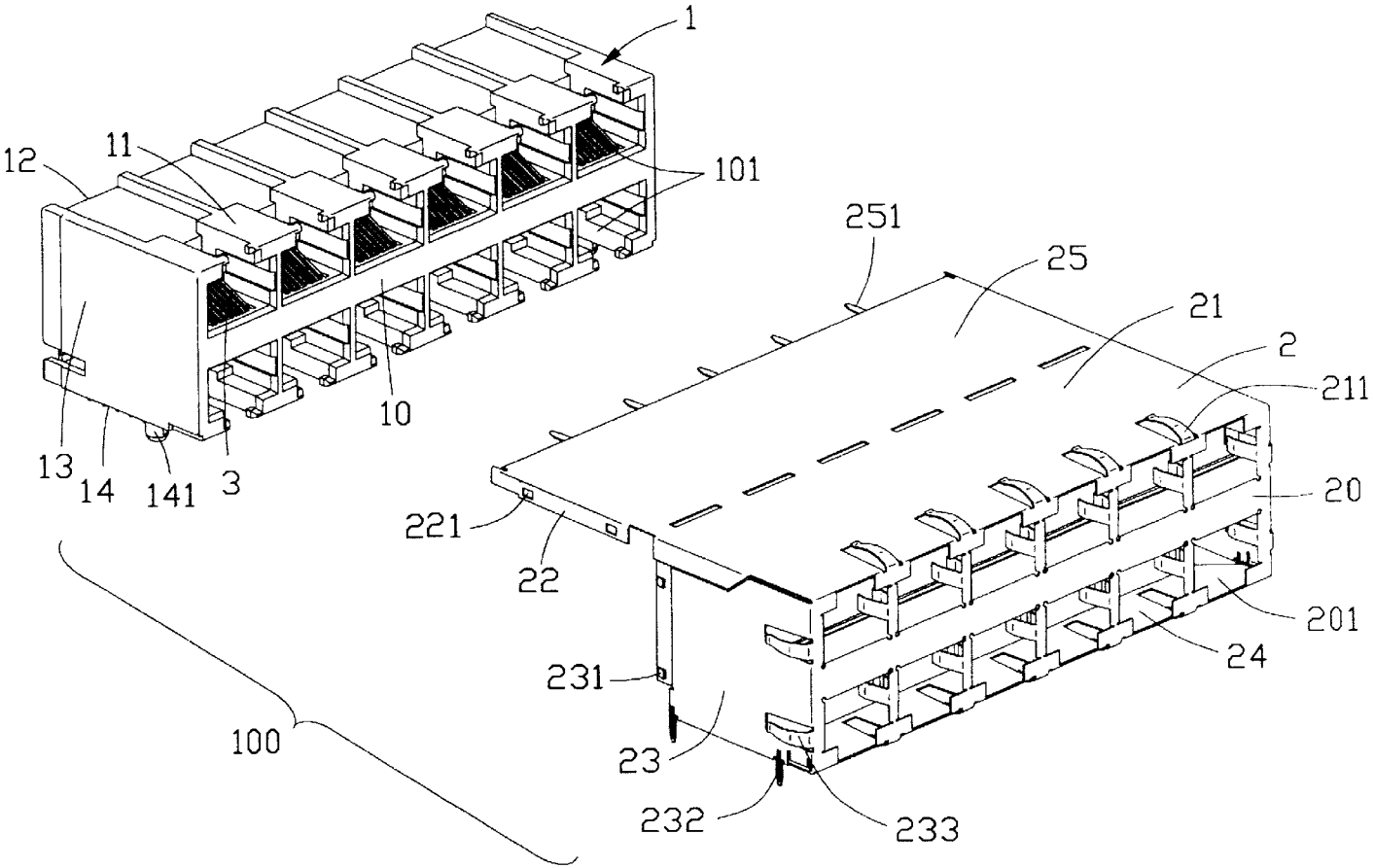
FIG. 1 is an exploded view of a modular jack according to the present invention.
Figure 2:
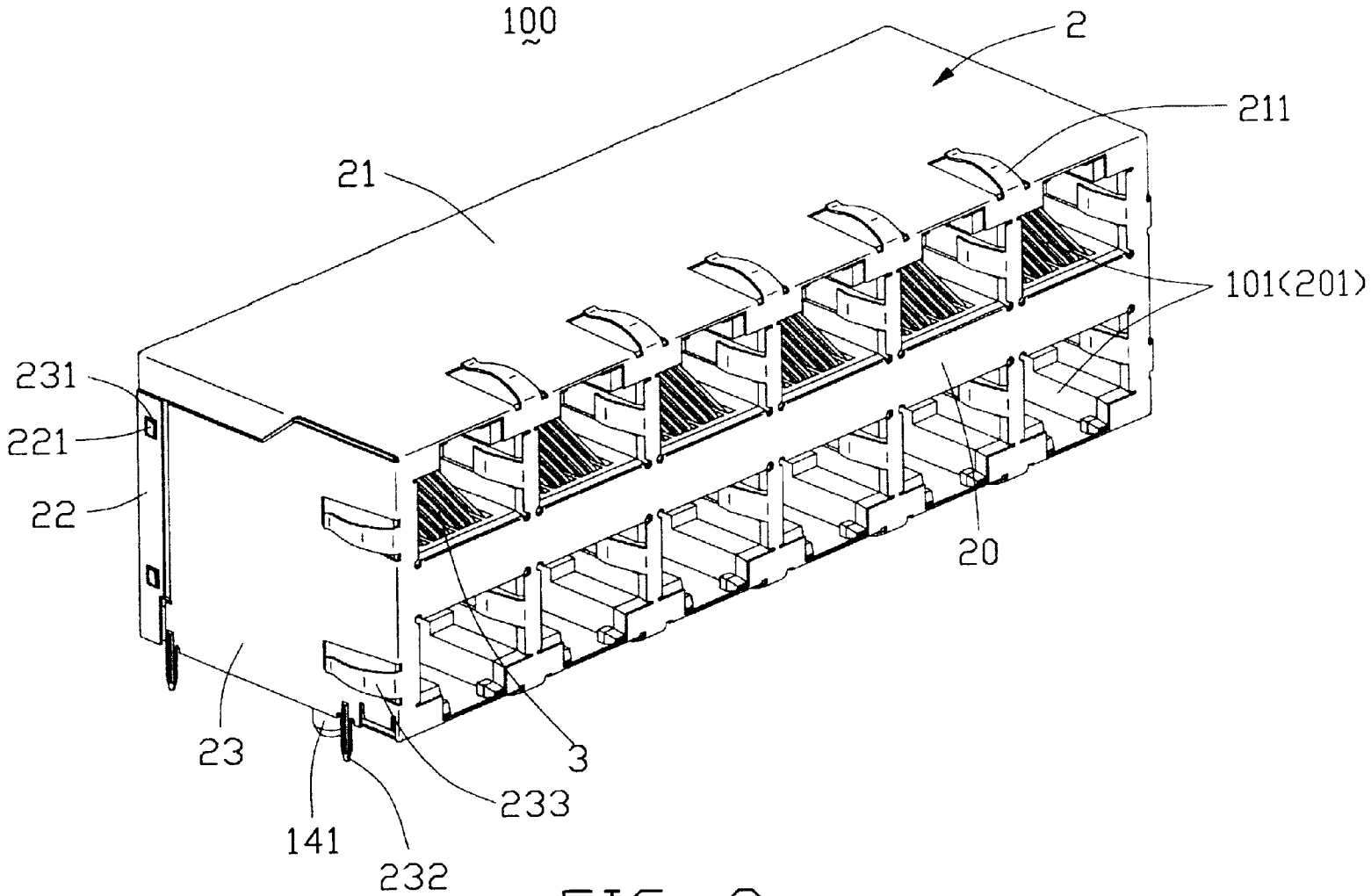
FIG. 2 is an assembled view of FIG. 1.

Referring to FIGS. 1 and 2, a modular jack 100 of the present invention is provided for mounted on a printed circuit board (PCB, not shown) and extends into a cavity 2001 of an electronic appliance 200, such as a server, and mounted on a printed circuit boards (PCB, not shown). The cavity 2001 of the electronic appliance 200 has a metallic inner circumference 2002. The modular jack 100 includes a molded insulative housing 1, a plurality of terminals 3 received in the housing 1, and a one-piece shell 2 surrounding and shielding the housing 1.

The housing 1 is substantially rectangular-shaped with a front, rear, upper, lower and two side surfaces 10, 12, 11, 14 and 13. The housing 1 defines a plurality of chambers 101 arranged in side-by-side and/or stacked relationship and exposed forwardly in the front surface 10. Each chamber 101 accommodates a plurality of terminals 3 and is adapted for receiving a mating plug (not shown). The housing 1 forms a pair of posts 141 extending downwardly from the lower surface 14 for securing the modular jack 100 to the PCB. A plurality of protrusions 142 are formed on the lower surface 14 for securing the shell 2 to the housing 1, which will be discussed later.

The shell 2 is stamped from one metal sheet into planar shape prior assembled to the housing 1, which is not shown in detail. FIG. 1 shows the shell 2 is partially folded for assembling to the housing 1. The shell 2 includes a front, rear, upper, lower and two side plates 20, 25, 21, 24, 23. The front plate 20 defines a plurality of openings 201 corresponding to the chambers 101 of the housing 1 for receiving the mating plugs, and a plurality of stamped upper tabs 211. The rear plate 25 includes a pair of retention plate 22 extending laterally from opposite sides. Each retention plate 22 defines a plurality of cutouts 221. Each side plate 23 forms a plurality of barbs 231 projecting outwardly by stamping. A plurality of lower tabs 241 projects downwardly from the lower plate 24 by stamping, thereby defining a plurality of holes 242 in the lower plate 24. The side plates 23 have a plurality of stamped side tabs 233. The side plates 23 and the rear plate 25 forms a plurality of grounding tails 232, 251.

Figure 3:
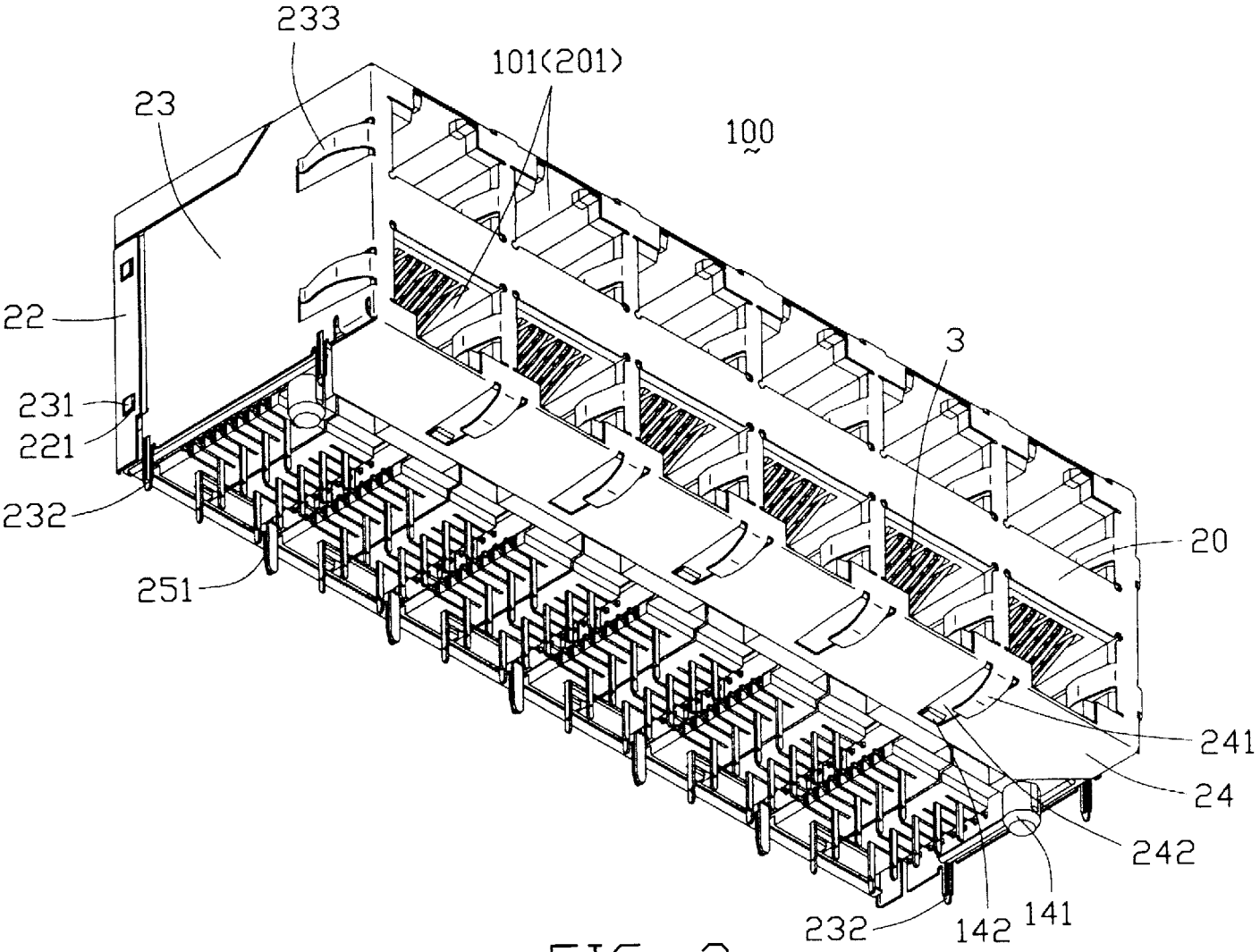
FIG. 3 is another assembled view of FIG. 1 taken from a bottom aspect.
Figure 4:
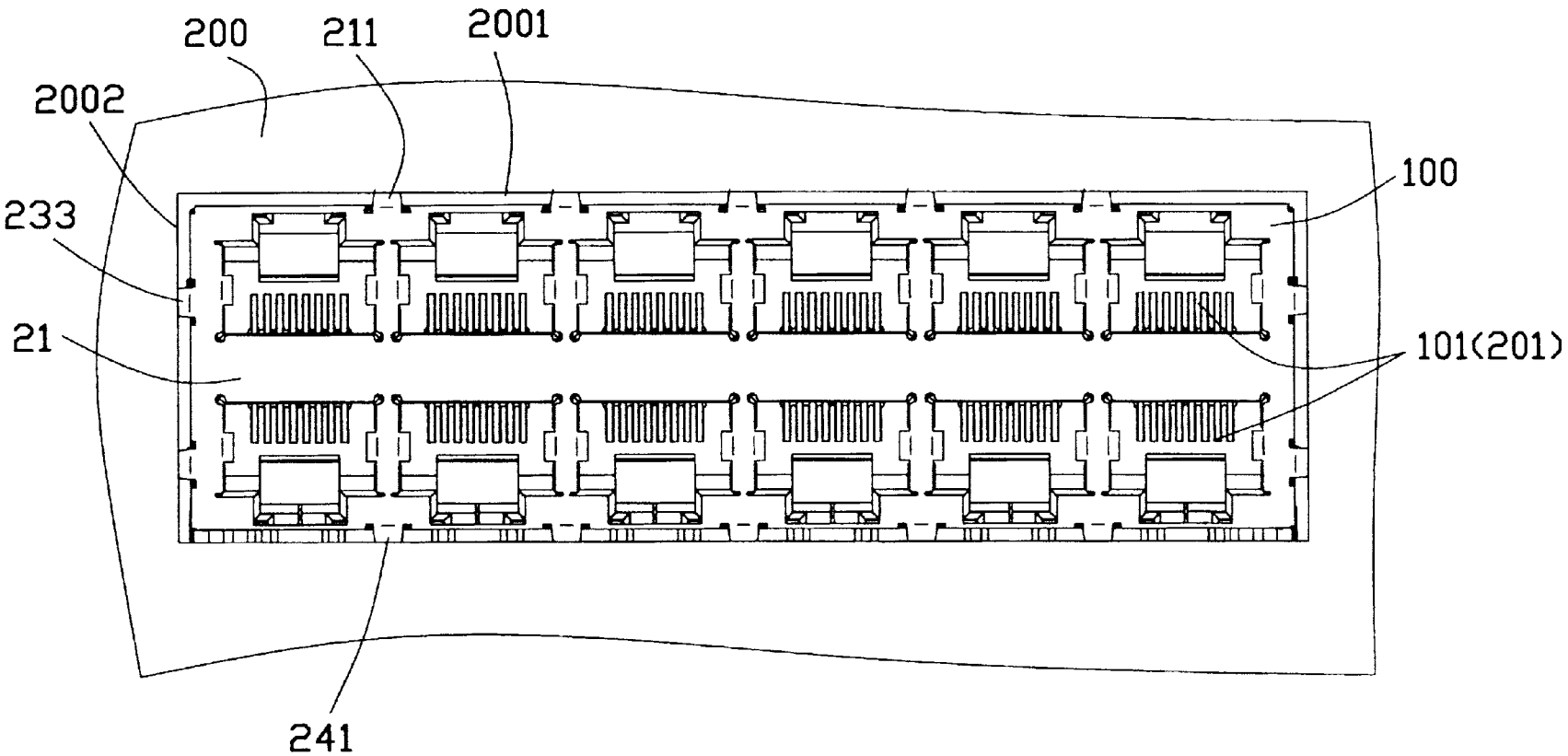
FIG. 4 is a front view of an electronic appliance assembly according to the present invention.

Referring to FIGS. 1 and 3, in assembly, the one-piece shell 2 is folded to surrounding and shielding the housing 1. The front plate 20 covers the front surface 10 of the housing 1 with the openings 201 in front of corresponding chambers 101 for permitting insertion of the mating plugs. The lower plate 24 is folded relative to the front plate 20 for partially covering the lower surface 14 of the housing 1. The protrusions 142 of the lower surface 14 engage with the holes 242 of the shell 2. The upper plate 21 is folded relative to the front plate 20 for covering the upper surface 11 of the housing 1. The side plates 23 are folded relative to the front plate 20 for covering opposite surfaces 13 of the housing 1. The rear plate 25 is bent relatively to the upper plate 21 for covering the rear surface 12 of the housing 1. The retention plates 22 of the rear plate 25 are folded to engage with side plates 23 with the cutouts 221 of the retention plate 22 engaging with the barbs 231 of the side plates 23. The posts 141 engage with corresponding holes (not shown) of the PCB. The grounding tails 232, 251 extend into corresponding soldering holes (not shown) of the PCB for grounding. The modular jack 100 is on the PCB and extends into the cavity 2001 of the electronic appliance 200. The upper, side and lower tabs 211, 233 and 241 interferentially engage with metallic inner circumference 2002 of the cavity 2001, thereby grounding the inner circumference 2002 of the cavity 2001 for avoiding electromagnetic interference (EMI).

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted in a cavity; with metallic inner surface, of an electronic appliance, comprising:

an insulative housing having at least one protrusion formed on an outer surface;

a plurality of terminals received in the housing; and a metal shell surrounding the insulative housing, and including at least one tab stamped from the shell and thereby defining a corresponding hole engaging with the protrusion of the housing;

wherein the shell includes a lower plate, said tab being stamped therefrom;

wherein the shell includes a rear plate and two side plates, each side plate having a plurality of barbs extending outwardly, the rear plate defining a plurality of cutouts engaging with said barbs;

wherein said connector defines at least two juxtaposed mating ports along a longitudinal direction of the housing, and said at least one tab is substantially located between said at least two juxtaposed mating ports along said longitudinal direction.

2. An electronic appliance assembly comprising:

an electronic appliance defining a cavity, the cavity has a metallic inner circumference; and an electrical connector received in the cavity of the electronic appliance, including:

an insulative housing having at least one protrusion on an outer surface thereof;

a plurality of terminals received in the housing; and a metal shell surrounding the insulative housing, and including at least one tab stamped from the shell and thereby defining a corresponding hole engaging with the protrusion of the housing;

wherein said at least one tab is deflectably pressed by the inner circumference;

wherein the shell includes a lower plate, said tab being stamped from the lower plate;

wherein the shell includes a rear plate and two side plates, each side plate having a plurality of barbs extending outwardly, the rear plate defining a plurality of cutouts engaging with said barbs;

wherein said connector defines at least two juxtaposed mating ports along a longitudinal direction of the housing, and said at least one tab is substantially located between said at least two juxtaposed mating ports along said longitudinal direction.

3. An electronic appliance assembly comprising:

a metallic panel defining an opening with a metallic inner circumference surrounding said opening; and an electrical connector including:

an insulative housing having at least one protrusion on an outer surface thereof;

a plurality of terminals received in the housing; and a metal shell surrounding the insulative housing, and including at least one tab stamped from a front portion of the shell and thereby defining thereabouts a corresponding hole engaging with the protrusion of the housing for securing the shell and the housing together; wherein the at least one tab is deflectably pressed by said inner circumference while the protrusion is located behind the panel;

wherein said connector defines at least two juxtaposed mating ports along a longitudinal direction of the housing, and said at least one tab is substantially located between said at least two juxtaposed mating ports along said longitudinal direction;

wherein the shell includes a lower plate, said tab being stamped from the lower plate;

wherein the shell includes a rear plate and two side plates, each side plate having a plurality of barbs extending outwardly, the rear plate defining a plurality of cutouts engaging with said barbs.

* * * * *